United States Patent [19]

Bitterlich

[11] 4,029,462

[45] June 14, 1977

[54] BURNER WITH NOISE SUPPRESSOR

[75] Inventor: Gordon M. Bitterlich, Tredyffrin Township, Chester County, Pa.

[73] Assignee: National Airoil Burner Co., Inc., Philadelphia, Pa.

[22] Filed: Dec. 10, 1975

[21] Appl. No.: 639,572

[52] U.S. Cl. ..... 431/114; 431/188; 431/284

[51] Int. Cl.[2] ..... F23C 7/04

[58] Field of Search ..... 431/114, 284, 285, 8, 431/DIG. 21, DIG. 22, 174, 187, 188

[56] References Cited

UNITED STATES PATENTS

| | | | |
|---|---|---|---|
| 3,217,779 | 11/1965 | Reed et al. | 431/285 |
| 3,244,220 | 4/1966 | Kloecker | 431/284 X |
| 3,486,834 | 12/1969 | Frey et al. | 431/284 X |
| 3,684,424 | 8/1972 | Zihk et al. | 431/114 |
| 3,940,234 | 2/1976 | Reed et al. | 431/114 |

*Primary Examiner*—Edward G. Favors

*Attorney, Agent, or Firm*—Z. T. Wobensmith, 2nd; Z. T. Wobensmith, III

[57] ABSTRACT

A combination oil and gas burner is shown with the noise attendant upon the delivery of the primary and secondary air for combustion and the noise of the combustion muffled or suppressed by sound absorbing material disposed to reduce sound transmission to a low level.

10 Claims, 7 Drawing Figures

FIG. 1
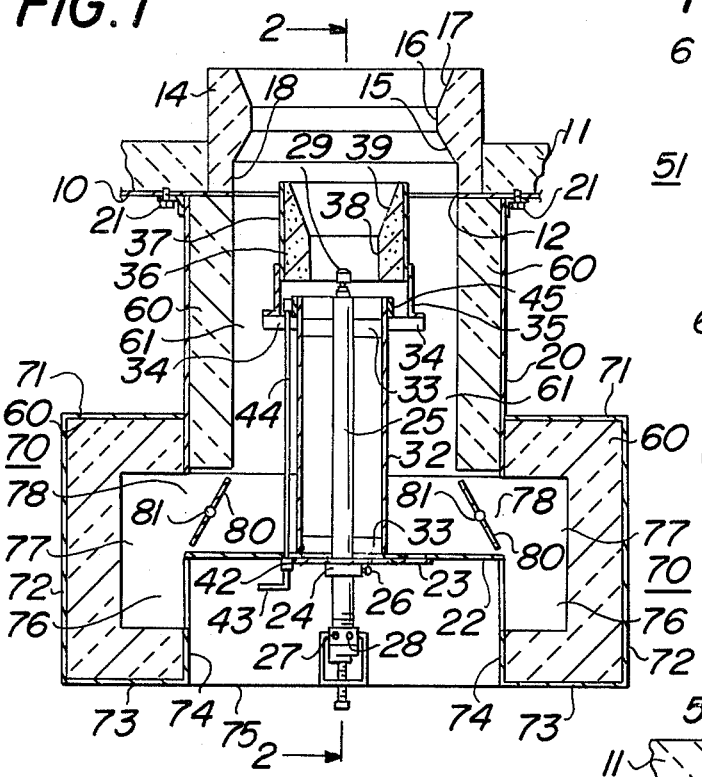
FIG. 5
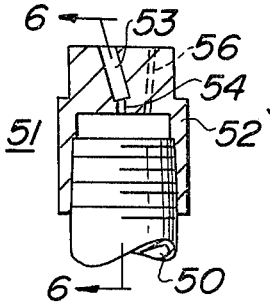
FIG. 6
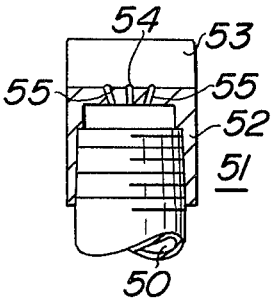
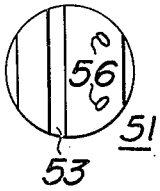
FIG. 4
FIG. 2
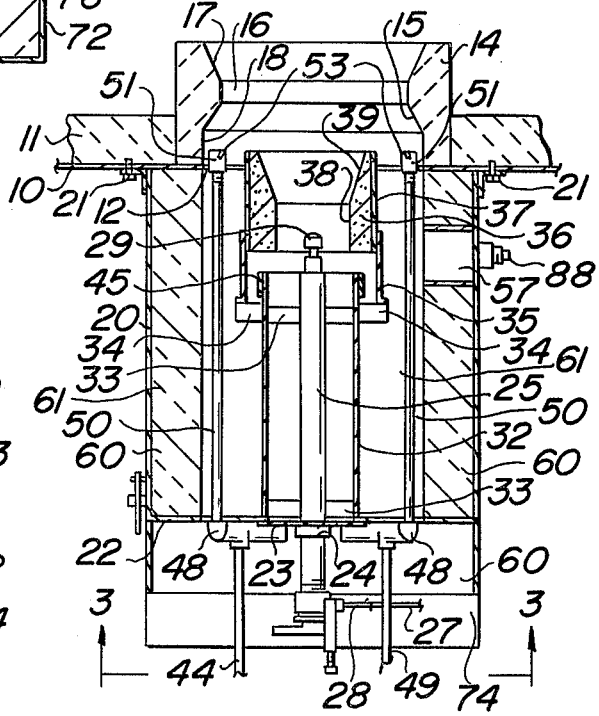
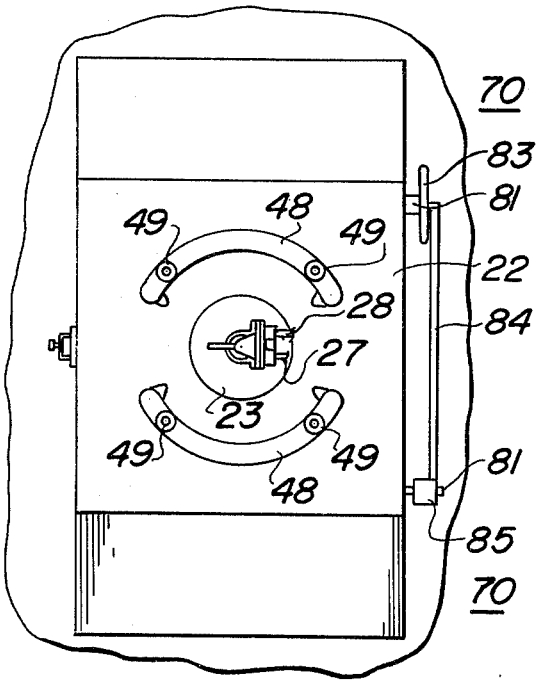
FIG. 3
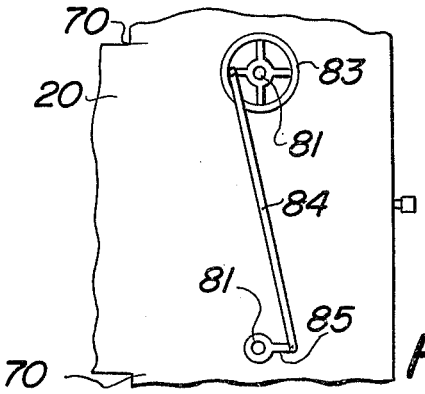
FIG. 7

BURNER WITH NOISE SUPPRESSOR

BACKGROUND OF THE INVENTION

1. Field of the Invention

This invention relates to combination burners for oil and gas and more particularly to structure for suppressing the noise attendant upon the entrance of the air for combustion and the combustion noise.

2. Description of the Prior Art

The noise attendant upon the operation of gas and oil burners is objectionable to persons in surrounding areas, and prolonged exposure may result in loss of hearing of operating personnel.

Various proposals have been made to reduce the noise level but none of these has proven wholly satisfactory.

In the U.S. Pat. No. 3,907,489, to Santisi, an inspirating gas burner is shown in which the pressure of the combustible gas is utilized to entrain the primary air, the primary air being admitted through openings facing toward the furnace and passing rearwardly and forwardly in a labyrinth path for inspiration by high pressure combustible gas into a bell for delivery into the furnace. The primary air in its rearward and forward passage into the bell is surrounded by a lining of a sound absorbing material. The admission of the primary air is controlled by an axially adjustable shutter. Secondary air for combustion, controlled by another axially adjustable shutter, is not shielded as to noise.

It has heretofore been proposed to provide combination burners, the U.S. Pat. No. 2,918,966 being illustrative. No provisions are shown in this patent for noise suppression.

SUMMARY OF THE INVENTION

In accordance with the invention a combination burner for oil and/or gas is provided, with controls for the primary and secondary combustion air, all the air for combustion being directed through a passageway with a plurality of changes of direction, the passageway being lined with sound absorbing material for quiet operation, the gas and oil nozzles being readily accessible for inspection, cleaning and maintenance.

It is the principal object of the invention to provide a combination burner which will be relatively quiet in its operation.

It is a further object of the invention to provide a burner of the character aforesaid in which the burner and air control components are readily accessible for inspection, cleaning and maintenance.

It is a further object of the invention to provide a combination oil and gas burner which is compact and free from operating problems.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which:

FIG. 1 is a longitudinal sectional view of a burner in accordance with the invention;

FIG. 2 is a longitudinal sectional view taken approximately on the line 2—2 of FIG. 1;

FIG. 3 is an exterior end elevational view as seen from the line 3—3 of FIG. 2;

FIG. 4 is an end elevational view, enlarged, of a gas burner tip which may be employed with the invention;

FIG. 5 is a vertical central sectional view of the gas burner tip of FIG. 4;

FIG. 6 is a sectional view taken approximately on the line 6—6 of FIG. 5; and

FIG. 7 is a fragmentary elevational view showIng the secondary air damper actuation.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF A PREFERRED EMBODIMENT

Referring now more particularly to the drawings a furnace wall plate 10 is shown which may be provided with a ceramic refractory lining 11. The wall plate 10 may be vertical, horizontal or inclined, although as illustrated they are shown as providing a horizontal wall or floor of a furnace.

The wall plate 10 has an opening 12 at which the burner is located. A muffle block 14 is mounted on the wall plate 10 in any desired manner, the muffle block having a converging conical. surface 15, a cylindrical surface 16 and a diverging conical surface 17, and a cylindrical entrance surface 18.

The burner of the present invention is mounted in longitudinal axial alignment with the muffle block 14.

A housing 20 is provided, preferably square in cross section and which can be detachably mounted on the wall plate 10 by bolts 21 if desired and has an outer frame plate 22 parallel to the wall plate 10.

The frame plate 22 has a tubular frame 32 rigidly secured thereto, the frame 32 having interior brackets 33 to which an oil burner guide tube 25 is secured. The frame 32 also has bracket arms 34 extending radially outwardly in supporting relation to a cylindrical shroud 35 which in turn supports a ceramic refractory burner block 36 within a burner block ring 37.

The inner terminus of the burner block 36 is located at the outer terminus of the muffle block 14 but is spaced inwardly from the surface 18 to provide an annular secondary air passageway as hereinafter explained.

The oil burner guide tube 25 has a closure and movable inspection plate 23 carried thereon and normally held in closed position by a set screw 26 in a hub 24 of the plate 23. Access to the interior can be had by loosening the set screw 26 and movement of the plate 23.

The oil burner guide tube 25 is threaded on its outer end to receive a complemental portion of an oil burner gun fixed detaching element 30. The element 30 has an oil supply connection 27 and an atomizing fluid supply connection 28 for air, steam or gas for atomizing the oil. The movable section of the detaching element 31 holds the atomizing gun components including a burner tip 29 for outward delivery of the atomized oil for combustion.

The burner block 36 has a cylindrical interior face 38 and a diverging conical face 39. The spray from the burner tip 29 is directed so as to pass along and spaced from the face 39 of the burner block 36 and along and spaced from the face 17 of the muffle block 14. The frame plate 22 carries a guide 42 for a primary air operating handle 43 from which a rod 44 extends for positioning a primary air controlling sleeve 45 slidable on the outer end of tubular frame 32 for any desired position of adjustment with respect to the burner block 36.

The outer frame plate 22 has mounted thereon gas manifolds 48 to which combustible gas is supplied through gas supply pipes 49.

The gas manifolds 48 have, extending inwardly therefrom and parallel to the oil burner tube 25 a plurality of gas burner tip supply pipes 50 each having a gas burner tip 51 carried thereon. The gas burner tips 51 are each located around the inner part of the burner block ring 37 and radially inwardly from the entrance surface 18.

While any suitable burner tips 51 can be employed it is preferred to use tips 51 such as are shown in FIGS. 4, 5 and 6.

The burner tips 51 each has a burner tip body 52 in threaded engagement with a burner tip supply pipe 50 with an inclined slot 53 extending from the extremity and to which combustible gas is supplied by openings 54 and 55 to provide a spreading or diverging flame with the flame inclined with respect to the longitudinal central axis of the burner to provide a conical gas flame pattern. Flame retention openings 56 for gas delivery can also be provided in the body 52.

Within the interior of the housing 20 and lining all four sides thereof an acoustical lining 60, preferably in board or panel form is provided, the burner block 36 and tubular frame 32 being spaced inwardly from the inner face of the lining 60 to provide an air passageway 61 in surrounding relation thereto.

The acoustical lining material can be of any desired and suitable type which is incombustible, has structural integrity and is capable of absorbing low frequency combustion noise as well as higher frequency noise attendant on gas and steam flow. In a specific embodiment the lining can be of thickness of the order of six inches. One suitable material is composed of high temperature mineral fibers bonded together with high heat resistant organic fibers in board form.

The housing 20 on opposite sides thereof has box extensions 70 with inner aligned transverse walls 71, parallel side walls 72 and outer aligned transverse walls 73, and flanges 74 with a lining 60 as before covering the walls 73, 72 and 71. The spacing of the outer ends of the box extensions 70 provides an air inlet opening 75 bounded at its inner extremity by the outer frame plate 22, transverse outward passageways 76, parallel extending passageways 76, parallel extending passageways 77 and transverse inward passageways 78 communicating with the inwardly directed passageway 61.

Within the passageways 78 air dampers 80 are provided in the form of vanes carried on shafts 81 journaled in the housing 20 and rotatable in opposite directions. For this purpose a hand wheel 83 keyed to one of the shafts 81 is pivotally connected to a link 84 which is in turn pivotally connected to an arm 85 keyed to the other of the shafts 81. Turning of the hand wheel 83 is thus effective to open the dampers 80 to the desired extent for delivery of air to the passageway 61 where it is available for primary air supply as controlled by the positioning of the control sleeve 45 and for secondary air supply around and beyond the burner block 36.

In operation the furnace is under negative pressure as determined by the exhaust fan (not shown) or stack (not shown).

Liquid fuel to be burned is supplied through the oil supply pipe 27 for atomization by steam supplied through the steam supply pipe 28. The atomized oil in the form of a hollow flaring and whirling cone directed toward the inner part of the face 38 of the burner block 36 where it is met by primary air induced through the air inlet opening 75 and passing through the passageways 76, 77, 78 and 61. The primary air is controlled by the positioning of the control sleeve 45.

Secondary air delivered through the passageway 61 passes around the exterior of the burner head 36 and into the muffle block 14 where it mixes with the burning combustibles advancing from the burner block 36.

Combustible gas supplied through the gas pipes 49, manifolds 48, pipes 50 and burner tips 51 in flaring flames directed in a hollow conical pattern is supplied with air advancing through the passageway 61 and advancing around the exterior of the burner head and into the muffle block 14 and along inner and outer faces of the hollow conical gas flame to aid in complete combustion of the combustibles of the gaseous fuel.

The gas and oil can be proportioned as desired, and in accordance with the availability thereof.

Noise of low frequency inside the furnace attendant upon the combustion upon attempting to exit through the muffle block 14 has no direct path for outward transmission but impinges on the exposed surface of the lining 60 in the housing 20 which has an absorbing effect. Any noise striking the burner block 36 is reflected to the lining. The outward path of noise, by reason of the arrangement of the passageways 78, 77 and 76 with their lining 60 is such that multiple reflection by the impact of the sound waves on the walls 60, 71, 72 and 73 and the exposed surfaces of the burner block 36, the tubular frame 32, the outer frame plate 22 and the closure plate 23 occurs with attenuation in the linings.

High frequency noise attendant upon gas flow through the burner tips 51, the flow of steam to and through the oil burner tip 29 and air entering through the opening 75 is attenuated and absorbed in the same manner as the low frequency noise.

If the burner is to be mounted horizontally rather than vertically as illustrated an oil discharge port 87 can be provided through the lining 60 which is closed by a drain plug 88.

I claim:

1. Combustion apparatus for negative draft furnaces having an opening in a wall of the furnace with a pressurized oil burner and pressure gas burners in communication therethrough with the interior of the furnace, a housing extending outwardly from said furnace for said burners and for air supply to said burners, said housing having wall portions providing an air passageway communicating with said opening, said wall portions having sound absorptive linings, said burners being disposed within said housing and spaced from said wall portions, said housing also having wall portions offset therefrom providing a tortuous air path communicating with said air passageway and with an air inlet opening to the atmosphere at the outer extremity thereof for air supply to the burners, said offset wall portions having sound absorptive linings, the tortuous path and the sound absorptive linings of said wall portions and said offset wall portions attenuating outwardly emitted high frequency fluid flow noise and low frequency combustion noise from the furnace opening by multiple reflection by the wall portions and offset wall portions and absorption by the sound absorptive linings.

2. Combustion apparatus as defined in claim 1 in which members are provided in the interior of said housing for controlling the supply of primary air from the interior of said housing to said oil burner.

3. Combustion apparatus as defined in claim 1 in which members are provided in the interior of said housing for controlling the supply of secondary air from the interior of said housing to said oil burner.

4. Combustion apparatus as defined in claim 1 in which members are provided in the interior of said housing for controlling the supply of air from the interior of said housing to said gas burners.

5. Combustion apparatus as defined in claim 1 in which a burner block is provided within said housing into which oil is delivered in atomized form for combustion, and members are provided in the interior of said housing for controlling the supply of primary air from the interior of said housing into said burner block.

6. Combustion apparatus as defined in claim 5 in which members are provided in the interior of said housing for controlling the supply of secondary air from the interior of said housing beyond said burner block.

7. Combustion apparatus as defined in claim 5 in which a muffle block is carried by the furnace wall through which the products of combustion from said gas burners are delivered with air from said air passageway.

8. Combustion apparatus as defined in claim 1 in which a frame member is provided in said burner housing on which said oil burner and said gas burners are mounted for access through said air inlet opening.

9. Combustion apparatus as defined in claim 1 in which damper means is provided in said tortuous path.

10. Combustion apparatus as defined in claim 9 in which a plurality of tortuous air paths are provided in communication with said air inlet opening, and said damper means comprises a damper in each of said tortuous paths, and operating means is provided for simultaneously controlling said dampers.

* * * * *